US006979418B1

(12) United States Patent
Harrington

(10) Patent No.: US 6,979,418 B1
(45) Date of Patent: Dec. 27, 2005

(54) METHOD TO CREATE IRREGULAR EDGE DECORATIVE BLOCKS

(75) Inventor: Paul Harrington, Port Byron, IL (US)

(73) Assignee: King's Material, Inc., Cedar Rapids, IA (US)

( * ) Notice: Subject to any disclaimer, the term of this patent is extended or adjusted under 35 U.S.C. 154(b) by 309 days.

(21) Appl. No.: 10/458,011

(22) Filed: Jun. 10, 2003

Related U.S. Application Data

(60) Provisional application No. 60/391,567, filed on Jun. 26, 2002.

(51) Int. Cl.[7] ..... B28B 11/08; B28B 11/12; B28B 7/22; B28B 3/02

(52) U.S. Cl. ..... 264/162; 264/138; 264/296; 264/333; 264/336; 425/308; 425/315; 425/422; 425/452; 125/2; 125/3; 125/8

(58) Field of Search ..... 264/138, 162, 264/296, 333, 336; 425/308, 315, 422, 452; 125/2, 3, 8

(56) References Cited

U.S. PATENT DOCUMENTS 1,735,497 A * 11/1929 Duty ..... 264/162
2,258,553 A * 10/1941 Hartley ..... 264/148
2,700,810 A * 2/1955 Garni ..... 425/127
2,779,080 A * 1/1957 Chidester ..... 425/441
2,867,204 A * 1/1959 Arvay ..... 125/6
3,694,128 A * 9/1972 Foxen ..... 425/412
3,918,210 A * 11/1975 Mori ..... 451/190
3,936,209 A * 2/1976 Krage ..... 404/75
4,495,132 A * 1/1985 Johnson ..... 264/293
4,655,981 A * 4/1987 Nielsen et al. ..... 264/162
5,133,915 A * 7/1992 Metten et al. ..... 264/162
5,223,200 A * 6/1993 Schulz et al. ..... 264/145
6,331,105 B1 * 12/2001 Lee ..... 425/324.1
6,803,002 B2 10/2004 Suto et al. ..... 264/162

* cited by examiner

*Primary Examiner*—Michael P. Colaianni

*Assistant Examiner*—Micheal I. Poe

(74) *Attorney, Agent, or Firm*—Allan L. Harms

(57) ABSTRACT

A method to create blocks having a weathered and aged look by modifying the blocks before they are cured. Green blocks exiting a block forming machine are conveyed along a path past brush elements which scrub block mix from the upper longitudinal corners of the formed, uncured blocks. The blocks are also passed longitudinally over tooth elements which irregularly remove block mix from the lower longitudinal corners of the green blocks. The modified green blocks are moved to a kiln for curing.

8 Claims, 4 Drawing Sheets

METHOD TO CREATE IRREGULAR EDGE DECORATIVE BLOCKS

CROSS-REFERENCE TO RELATED APPLICATIONS

This application claims priority from provisional patent application entitled "METHOD AND APPARATUS TO CREATE IRREGULAR EDGE DECORATIVE BLOCK", Ser. No. 60/391,567 filed Jun. 26, 2002, now abandoned. The disclosure of provisional patent application Ser. No. 60/391,567 is hereby incorporated in its entirety.

STATEMENT REGARDING FEDERALLY SPONSORED RESEARCH OR DEVELOPMENT

Not Applicable.

BACKGROUND OF THE INVENTION

In the manufacture of decorative concrete blocks for retaining walls and like uses, it is customary to achieve a weathered and aged look by tumbling the cured blocks in a drum or similar tumbling apparatus to cause blocks to collide and damage their edges. This process is labor intensive and time consuming because the cured blocks must be loaded into the tumbling apparatus and then removed therefrom. In addition, some wastage of finished products occurs because of the impacts of blocks upon each other. Since blocks of this type are frequently molded in three-piece sets, when one piece of a set of three is damaged, the set is incomplete and palleting of the sets is delayed and obstructed.

SUMMARY OF THE INVENTION

The present invention provides a method to achieve blocks having a weathered and aged look by modifying the blocks before they are cured, that is, while they are "green". Green blocks exiting the block forming machine are carried on flat pallets which support the blocks in three-block sets as they leave the block forming machine. The pallets carrying the green blocks are conveyed along a path past brush elements which scrub block mix from the upper longitudinal corners of the formed, uncured blocks. The blocks are also passed longitudinally over tooth elements which irregularly remove block mix from the lower longitudinal corners of the green blocks. The brush elements are disposed such that the bristles thereof are directed at a non-perpendicular to the adjoining faces of the block, that is, the bristles are non-perpendicular to either the top or the longitudinal side faces of the formed, uncured block and they drag along the upper corners of the green blocks, scrubbing some of the block mix from the green blocks. The blocks are passed longitudinally over a pair of teeth, each of which is carried on an arm which is freely rotatable about an axis carried at a height above the height of the blocks carried on the flat pallets. Each tooth is mounted at the free end of the arm to which is attached, and is directed perpendicularly toward the longitudinal face of the block passing thereby. The arms are of sufficient weight to ride along the upper face of the pallet carrying the blocks such that the teeth may drag block material from the lower edges of the green blocks as the blocks are carried past the teeth. The trimmed block material may be blown from the pallet by compressed air from nozzles directed toward the pallet beside the blocks thereon. After being thus modified, the formed green blocks are moved to a kiln for curing. The cured blocks may be stacked on pallets for delivery without further processing.

It is an object of the invention to provide an expedient and cost efficient method to create retaining wall blocks which appear to be aged and irregular.

BRIEF DESCRIPTION OF THE SEVERAL VIEWS OF THE DRAWING(S)

DETAILED DESCRIPTION OF THE INVENTION

Figure 1:
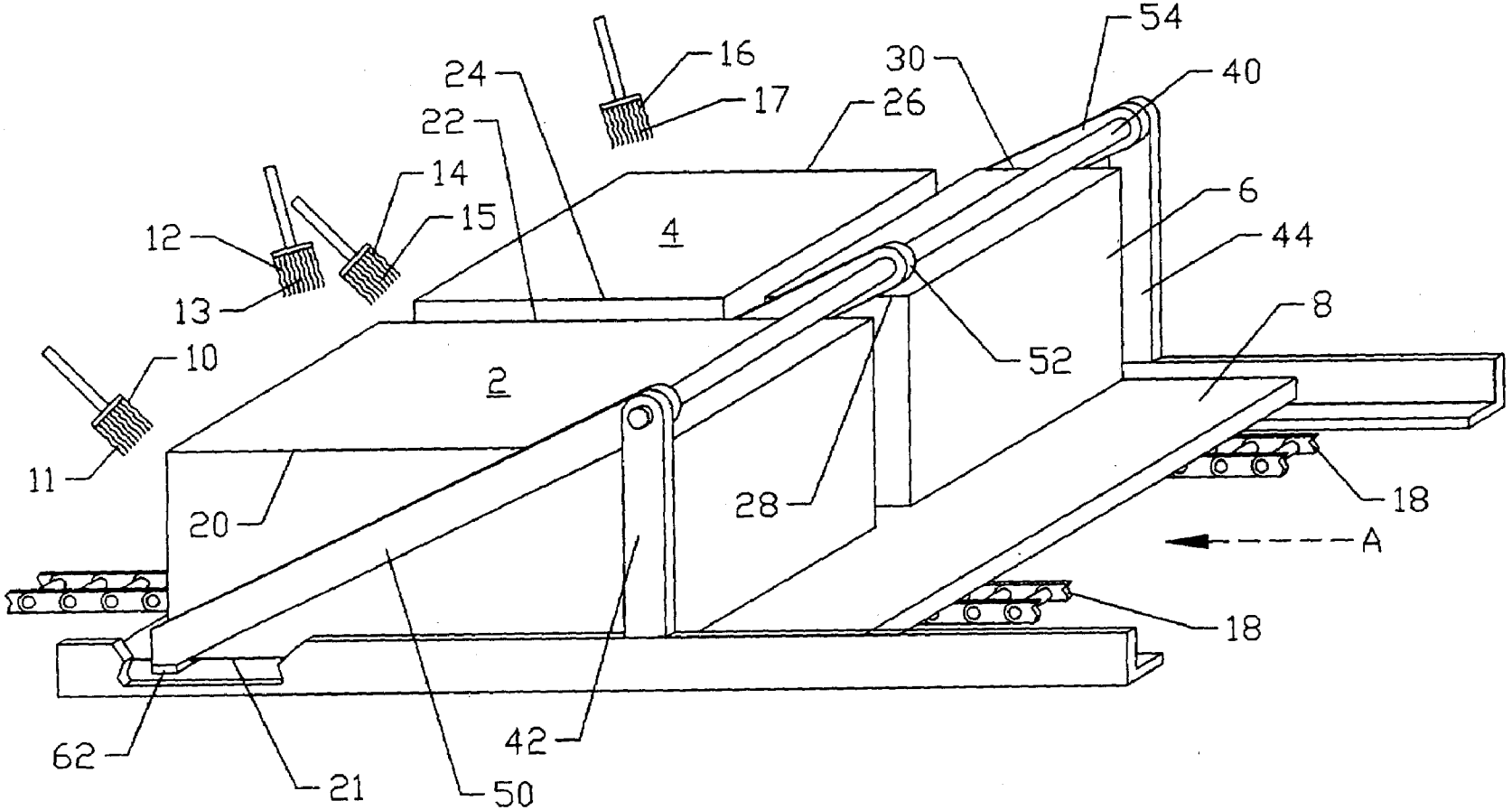
FIG. 1 is a perspective of a set of green blocks passing by the processing apparatus of the invention.

The present invention provides a method to create retaining wall or other decorative blocks having a weathered and aged look by modifying the blocks before they are cured, that is, while they are "green". Referring to the figures, green blocks 2, 4, 6 are shown following their formation on a conventional block forming machine (not shown). As formed on the block making machine, blocks 2, 4, and 6 have substantially square upper longitudinal corners 20, 22, 24, 26, 28, and 30 respectively. Blocks 2, 4, and 6 also are formed with substantially square lower longitudinal corners such as lower longitudinal corner 21 of block 2 shown in FIG. 1. Blocks 2, 4, 6 are carried on a flat pallet 8 which supports the blocks 2, 4, 6 in three-block sets as they are conveyed away from the block forming machine. Block 2 is a full size retaining wall block, block 4 is a generally two-third size retaining wall block and block 6 is a generally one-third size retaining wall block. Various combinations of blocks 2, 4, 6 may be formed together and carried on pallet 8. Pallet 8 carrying the green blocks 2, 4, 6 is conveyed by conveyor 18 along a path in the direction of arrow A past brush elements 10, 12, 14, and 16. Brush elements 10, 12 scrub uncured block mix from the upper longitudinal corners 20, 22 of formed, uncured block 2. Brushes 14, 16 are positioned in the path of blocks 4 and 6 such that brushes 14, 16 will scrub uncured block mix from the upper longitudinal corners 24, 26 and 28, 30 respectively of formed, uncured blocks 4 and 6 as they are carried on pallet 8 past brushes 14, 16. The brushes 10, 12 are disposed such that the bristles 11, 13 respectively thereof are directed at approximately forty-five degrees from vertical toward the upper longitudinal corners 20, 22 of block 2. The brushes 14, 16 are disposed such that the bristles 15, 17 respectively thereof are directed at approximately 45 degrees toward the upper longitudinal corners 24, 26 of block 4 and longitudinal corners 28, 30 of block 6. Bristles 11, 13, 15, and 17 must be quite stiff and coarse to be effective in scrubbing off compressed block mix. In the preferred embodiment of FIG. 1, bristles 11, 13, 15, and 17 are constructed of rigid nylon.

It may be seen that blocks 2, 4 are passed under horizontal axle 40 which is supported by first upright 42 and second upright 44. Arms 50, 52, 54 are hinged to axle 40 and are freely pivotable about the axis of axle 40. Arms 50, 52, 54 are angled downward in the direction of arrow A and are biased by their weight or by springs or other like biasing means to slide along top surface 38 of pallet 8.

Figure 2:
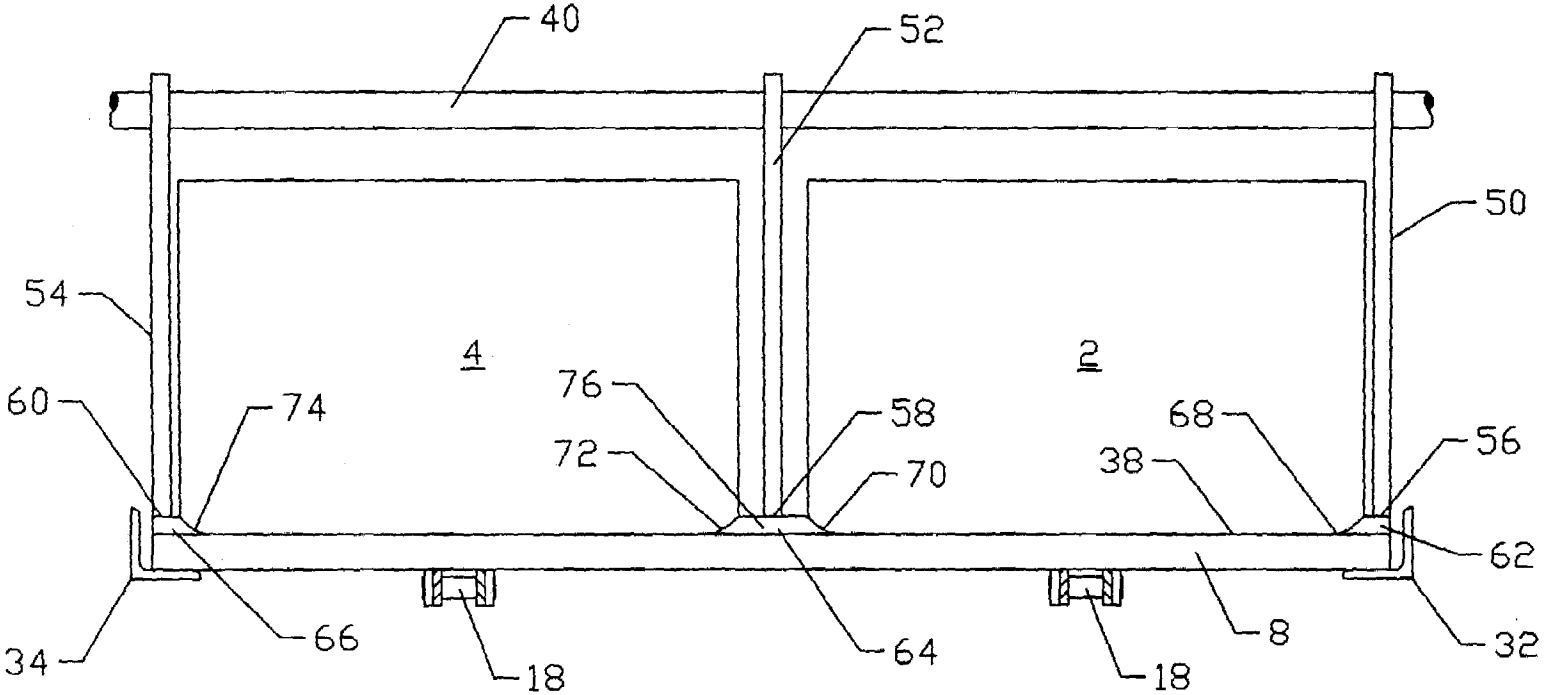
FIG. 2 is a side plan view of a pair of blocks approaching the lower corner processing apparatus of the invention.

Referring now particularly to FIG. 2, it may be seen that first outer arm 50 and central arm 52 are positioned on axle 40 such that block 2 may pass between arms 50 and 52. Similarly second outer arm 54 is positioned on axle 40 relative to central arm 52 such that blocks 4 and 6, which are substantially longitudinally aligned, will pass between arms 52, 54. First outer arm 50 is provided with a tooth 62 at the bottom of its free end 56. Tooth 62 is fixed to free end 56 at a perpendicular such that tooth 62 slides along upper surface 38 of pallet 8 and extends toward block and touchingly engages the first lower longitudinal corner 21 of block 2. As tooth 62 slides along top surface 38, as pallet 8 moves in the direction of arrow A, tooth 62 crumbles block mix from the first lower longitudinal corner 21 of block 2, creating an irregular non-square corner on block 2. Preferably tooth 62 is constructed of hard, abrasion resistant material such as hardened steel.

As seen in FIG. 2, a two-headed tooth 64 is fixed to the free end 58 of central arm 52. Tooth 64 is perpendicularly mounted at free end 58 of arm 52 such that tapered first cusp 70 of tooth 62 will touchingly engage the inboard lower longitudinal corner of block 2 and opposing tapered second cusp 72 of tooth 64 will touchingly engage the lower longitudinal corner of block 4 closest to arm 52 and, as with the operation of tooth 62, tooth 64 will crumble block mix from the inboard lower longitudinal corners of block 2 and blocks 4 and 6 as they pass by.

Likewise tooth 66 is mounted at the bottom of free end 60 of arm 54. Tooth 66 is perpendicularly mounted to arm 54 so that cusp 74 of tooth 66 will touchingly engage the outer lower longitudinal corner of block 4 as tooth 66 is slid along top surface 38 of pallet 8 as it is conveyed past axle 40. Each of cusps 68, 74 of teeth 62, 66 respectively is tapered to be narrowest at its free end. The taper may be generally concave at the upper side of the tooth 62, 66. Cusps 70, 72 are formed to have a taper or concave narrowing from central base 76 of tooth 64 to the ends of cusps 70, 72. The arms 50, 52, 54 are of sufficient weight to ride along the upper surface 38 of the pallet 8 carrying the blocks 2, 4, 6 such that the teeth 62, 64, 66 may drag block material from the lower longitudinal edges of the green blocks 2, 4, 6 as the blocks 2, 4, 6 are carried past the teeth 62, 64, 66.

Figure 3:
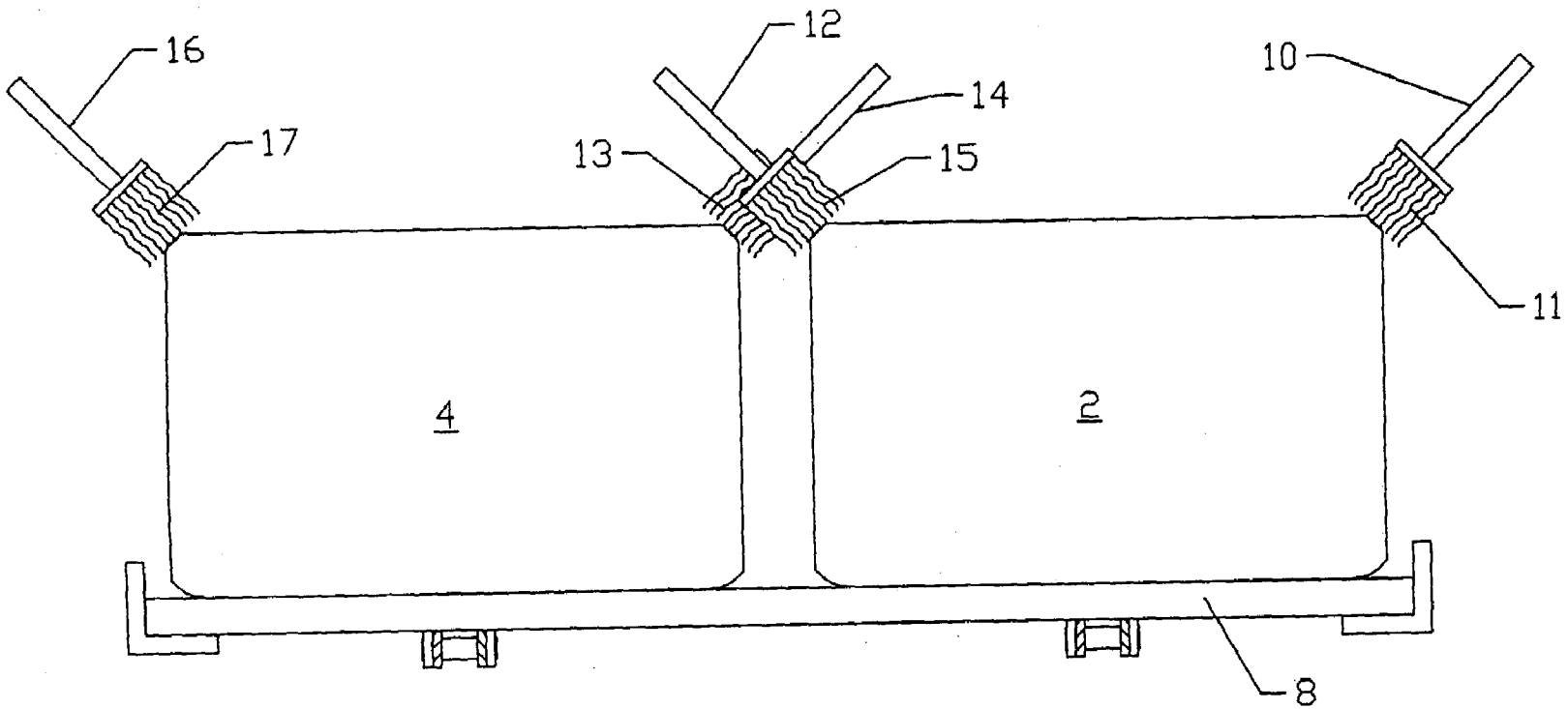
FIG. 3 is a side plan view of the upper corner brush apparatus of the invention as a pair of blocks approach it.

FIG. 3 shows the blocks 2 and 4 having block mix scraped from their upper longitudinal corners by bristles 11, 13, 15, and 17, the lower longitudinal corners of the blocks 2, 4, and 6 having been irregularly rounded by the teeth 62, 64, 66. The trimmed block material may be blown from the pallet 8 by compressed air directed toward the pallet 8 beside the blocks 2, 4, 6 thereon. After being thus modified, the formed green blocks 2, 4, 6 are moved to a kiln for curing. The cured blocks may be stacked on pallets for delivery without further processing.

Figure 4:
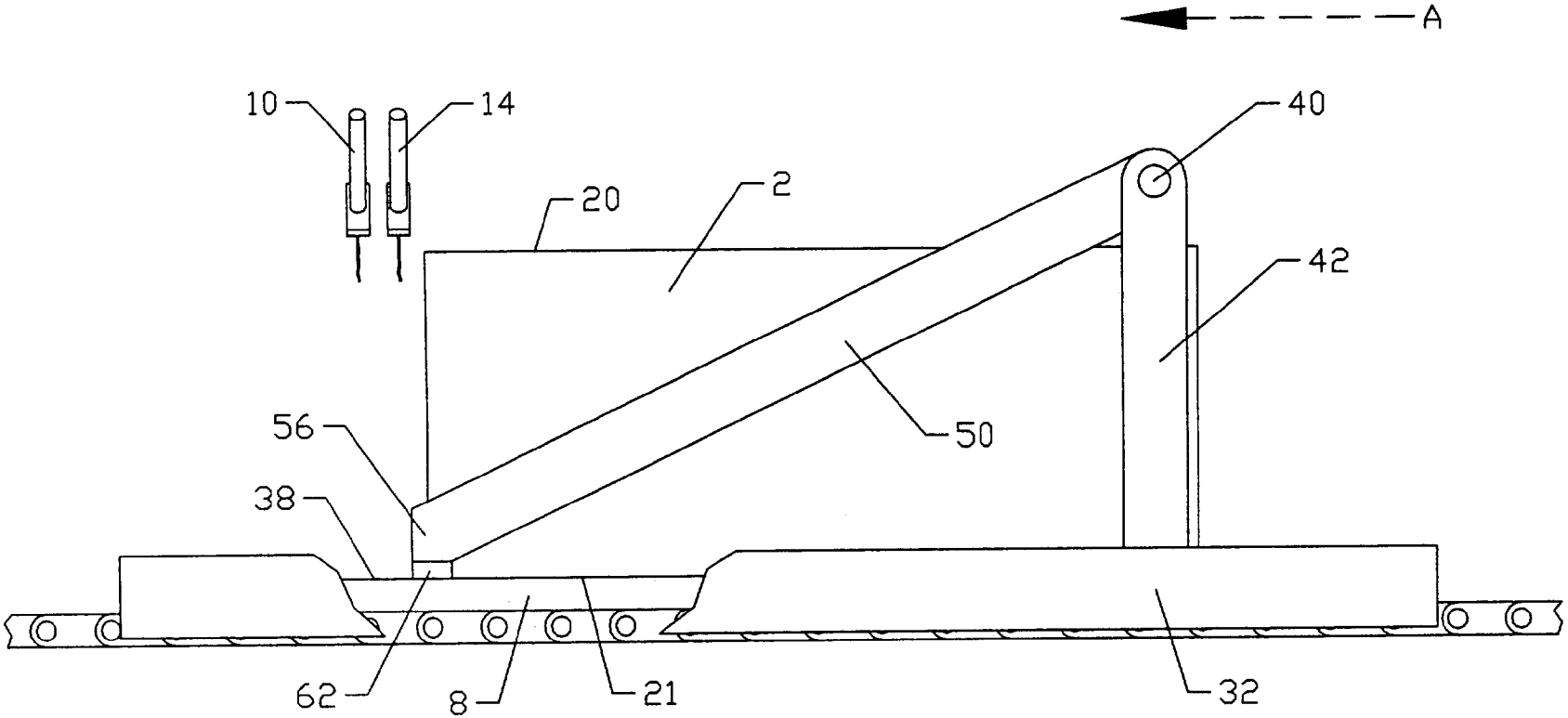
FIG. 4 is a front elevation of the processing apparatus of the invention.

FIG. 4 shows that tooth 62 will touchingly engage lower longitudinal corner 21 of block 2 before brushes 10, 12 begin to scrape block mix from upper long corner 20 of block 2. However, brushes 10, 12 could be positioned to engage block 2 before tooth 62 engages block 2, or they may be positioned so both operations occur at the same time. Brushes 10, 12 and brushes 14, 16 are disposed out of transverse alignment due to the space needed to position the brushes relative to the blocks 2 and 4. Other spatial arrangements of brushes 10, 12 or brushes 14, 16 relative to the free ends 56, 58 and 60 of arms 50, 52, and 54 respectively could be made. However preferably, the free ends 56, 58, and 60 would be in transverse alignment to avoid misaligning forces from being applied to the blocks 2, 4, and 6.

Many variations of this structure could be considered without departing from the method described herein.

Having described the invention, I claim:

1. A method to modify decorative blocks before curing, to produce an aged and weathered appearance thereon comprising the steps of:

forming a block of zero slump block mix in a mold, extruding the block from the mold onto a flat pallet, drawing a scraping member across the longitudinal upper corners of the block to remove block mix from the longitudinal upper corners, and drawing an engaging member along the lower longitudinal corners of the block between the block and the pallet such that the engaging member rides along the upper surface of the pallet to remove block mix from the lower longitudinal corners.

2. The method of claim 1 wherein the engaging member comprises a tooth extending generally perpendicularly toward a longitudinal side of the block, the tooth is carried on an arm, the arm is pivotable about an axis disposed above the block, the tooth is removably fixed to the free end of the arm, and the tooth passes along the upper surface of the pallet as the pallet travels past the axis of the arm.

3. A method to create a block which appears aged and weather beaten, comprising the steps of:

forming an uncured block from zero slump block mix in a mold, extruding the uncured block from the mold onto a flat pallet, the uncured block having upper longitudinal corners and lower longitudinal corners, non-uniformly removing block mix from the upper longitudinal corners of the uncured block by drawing a scraping member along and in touching contact with each longitudinal upper corner of the uncured block, non-uniformly removing block mix from the lower longitudinal corners of the uncured block by drawing an engaging member along and in touching contact with each lower longitudinal corner of the uncured block between the uncured block and the pallet such that the engaging member rides along the upper surface of the pallet, and curing the uncured block.

4. The method of claim 3 wherein the engaging member is a tooth extending generally perpendicularly toward a longitudinal side of the block, the tooth is carried on an arm, the arm is pivotable about an axis disposed above the uncured block, and the tooth is removably fixed to a free end of the arm.

5. The method of claim 3 wherein the scraping member is a stiff brush disposed to touchingly engage the longitudinal upper corner of the uncured block.

6. The method of claim 3 wherein the scraping member is drawn across the longitudinal upper corners of the uncured block by passing the uncured block past a brushing station comprising first and second brush members, each brush member touchingly engaging one upper longitudinal corner of the uncured block, the engaging member is drawn along the lower longitudinal corners of the uncured block by passing the uncured block past a pair of opposing teeth, each tooth touchingly engaging one lower longitudinal corner of the uncured block.

7. The method of claim 3 further comprising drawing a scraping member along each longitudinal upper corner of the uncured block contemporaneously.

8. The method of claim 7 further comprising contemporaneously drawing an engaging member along each lower longitudinal corner of the uncured block between the uncured block and the pallet.

* * * * *